US008641442B2

(12) United States Patent
Svelnis et al.

(10) Patent No.: US 8,641,442 B2
(45) Date of Patent: Feb. 4, 2014

(54) COMPACT LATCHING MECHANISM FOR A MID-POWER ELECTRICAL CONNECTOR

(75) Inventors: Christine M Svelnis, Boylston, MA (US); Charles L York, Townsend, MA (US)

(73) Assignee: Anderson Power Products, Inc., Sterling, MA (US)

( * ) Notice: Subject to any disclaimer, the term of this patent is extended or adjusted under 35 U.S.C. 154(b) by 29 days.

(21) Appl. No.: 13/457,677

(22) Filed: Apr. 27, 2012

(65) Prior Publication Data

US 2013/0288510 A1 Oct. 31, 2013

(51) Int. Cl.
*H01R 13/627* (2006.01)

(52) U.S. Cl.
USPC ..... 439/358

(58) Field of Classification Search
USPC ..... 439/350–358, 304
See application file for complete search history.

(56) References Cited

U.S. PATENT DOCUMENTS 7,234,957 B2 * 6/2007 Wang ..... 439/353
2003/0156797 A1 8/2003 Stephen
2004/0121642 A1 * 6/2004 Jones et al. ..... 439/350
2006/0217003 A1 9/2006 Martin et al.
2006/0276071 A1 12/2006 Rossi
2011/0189877 A1 8/2011 Svelnis et al.
2011/0244710 A1 10/2011 Svelnis et al.

OTHER PUBLICATIONS

PCT Search Report and Written Opinion for PCT Application No. PCT/US2012/035347, dated Jan. 2, 2013, 8 pages.

* cited by examiner

*Primary Examiner* — Ross Gushi
(74) *Attorney, Agent, or Firm* — Maine Cernota & Rardin

(57) ABSTRACT

A latching mechanism for a mid-power electrical connector is compact, strong, easy to disengage, durable, and low in manufacturing cost. The basic system includes a plug housing and a receptacle housing, each molded from plastic as a single piece, and at least one simple, mainly flat, metal latching tab inserted into a side of the plug housing. During connection of the housings, the latching tabs flex inward as they enter channels in the receptacle housing, and then spring outward to engage with receptacle latching features. In embodiments, wedge-shaped inward plastic protrusions in the channels engage with holes in the latching tabs. Unlatching requires only pressing the latching tabs gently inward. In embodiments, plastic pressing tabs can be pressed inward with fingers to flex and release the latching tabs. In other embodiments, the latching tabs are inaccessible to fingers, and a tool is required to release the latching tabs.

10 Claims, 16 Drawing Sheets

COMPACT LATCHING MECHANISM FOR A MID-POWER ELECTRICAL CONNECTOR

FIELD OF THE INVENTION

The invention relates to electrical connectors, and more particularly, to latching systems for mid-power electrical connectors.

BACKGROUND OF THE INVENTION

Single-contact and multiple-contact electrical connector systems are widely used for many household and industrial applications. Typically, such connector systems include a plug and a compatible receptacle, each of which includes one or more electrical contacts which are interconnected when the plug is mated with the receptacle. Plug and receptacle housings or "shells" are provided which position the contacts in alignment with each other, maintain the contacts in secure connection with each other, and protect the electrical contacts from the environment when the connectors are mated. Typically, the housings at least partly overlap when the connectors are mated, with the outer housing being referred to as the "receptacle" and the inner housing being referred to as the "plug." Often, a latching mechanism is included with the housings so as to avoid inadvertent separation of the plug from the receptacle.

Mid-power connector systems typically must be able to support and protect one or more high current connections and/or a plurality of densely packed connections under conditions that may be environmentally and/or physically challenging. For example, connectors used in solar or wind-power installations are often required to support high currents and to withstand exposure to sun, wind, and rain. Mid-power connectors used in a marine environment such as on a drilling platform or on a yacht may be exposed to prolonged salt spray. Connectors used in industrial environments, such as in food processing plants, may be exposed to periodic impact by pressurized water during cleaning operations.

In some applications, it is desirable for mid-power connectors to be as compact as possible. For example, in solar power installations and in yachts it is often necessary for a plurality of mid-power connectors to be co-located in a limited space, either as separate pairs of connectors or as a plurality of closely-spaced connectors attached to a panel. In addition, it is often desirable for mid-power connectors to be easily and quickly connected and disconnected. And in some applications, mid-power connectors are required by applicable codes to be releasable only through use of a tool.

FIG. 1A is a perspective view of a prior art mid-power connector plug 100 which accepts a plurality of male or female pins 102 (a male pin 102 is illustrated) that can be installed in a male connector body 104." The plug 100 includes a housing 106 in which are formed three spiral grooves 108. The matching receptacle 110 is illustrated in FIG. 1B. A female pin 112, representative of a plurality of male and/or female pins, is illustrated as being inserted into the receptacle connector body 114. The receptacle housing 116 is surrounded by a large collar 118 which can rotate freely about the housing 116. The collar 118 has three latching pins 120 inserted at equally spaced locations about its circumference, which extend inward and mate with the three spiral slots 108 of the plug housing, so that rotation of the collar 118 pulls the plug and receptacle housings together and locks them into place. In addition, the plug housing 106 includes "wear pins" 122 that retain the collar 118 in its locked position and inhibit it from inadvertently rotating and releasing if the plug and receptacle are pulled in opposite directions.

While the prior art connector of FIGS. 1A and 1B are operable, they have several deficiencies. First, the latching mechanism provided by the plug housing slots 108 and the receptacle housing and collar 118 is very bulky. This is especially true if they are manufactured out of plastic, since plastic parts in this design must be very thick to provided sufficient durability and performance. The bulk can be reduced by making the housings 106, 116 and collar 118 from a metal, such as stainless steel, but in that case the mechanism is very expensive, due to the number and complexity of the metal parts required 106, 116, 118, 120, 122.

In addition, under typical conditions of use, installation and release of the connectors can require application of a significant amount of twisting force to the rotatable collar 118, possibly while holding the plug stationary with the other hand. Depending on the physical strength of the user, this can lead to strains or other injuries. And under conditions where the connectors are packed closely together or are otherwise located in cramped spaces, it can be difficult for a user to surround the collar 118 with his or her fingers and apply the required torque, especially if it is also necessary to hold the plug housing 106 with the other hand.

What is needed, therefore, is a latching mechanism for a mid-power connector system that is comfortable, easy, and safe to engage and release, even under cramped conditions, highly compact, durable, and inexpensive to manufacture.

SUMMARY OF THE INVENTION

The present invention is a latching mechanism for a mid-power electrical connector that is comfortable, easy, and safe to engage and release, even under cramped conditions, highly compact, durable, and inexpensive to manufacture. The latching mechanism includes a plug housing and a receptacle housing, each of which is molded from plastic as a single piece, thereby minimizing the cost. At least one metal latching tab is inserted and retained on a side of the plug housing. In embodiments, a pair of metal latching tabs are inserted and retained on opposing sides of the plug housing. During insertion of the plug into the receptacle, the latching tabs flex inwardly on living hinges as they enter latching channels in the receptacle housing. When the housings are fully mated, the latching tabs spring outward to engage with corresponding latching features provided on opposing sides of the receptacle housing.

The latching tabs are metal inserts that are mainly flat and relatively simple in shape, thereby providing the durability and holding strength of metal at a minimal cost of manufacture. Unlike latching mechanisms of the prior art, no additional pins or other parts are needed. Manufacture of the complete housing and latching system therefore requires only molding of the two plastic housings, stamping out of the one or more metal latching tabs, and pushing of the latching tabs into retaining slots in the plug housing. Joining of the housings requires only aligning and pushing them together until the latching tabs snap into engagement with the latching features. Unlatching requires only that the two latching tabs be pressed gently inward until they disengage from the latching features, after which the two housings can be pulled apart.

In embodiments, the latching features are openings in the receptacle housing into which protrusions formed in the latching tabs are inserted when the two housings are joined. In other embodiments, the latching features are inward protrusions formed from the plastic of the receptacle housing that are inserted into openings in the latching tabs when the two housings are joined.

In some embodiments, the latching tabs are at least partly covered by plastic pressing tabs that are formed as part of one of the housings and can be pressed inward on living hinges so as to press upon and release the latching tabs. The pressing tabs thereby provide pressing targets which can be easily located by touch even if they are not directly visible, and which are comfortable to press on, since they are molded from plastic and lack any sharp edges that might be associated with the metal latching tabs.

In other embodiments, the latching tabs are covered by fixed portions of the plug housing, and are not accessible to the fingers of a user, so that a tool must be inserted through release openings provided in the plug or receptacle housing so as to press upon and release the underlying latching tabs.

The present invention is an electrical connector housing and latching system that includes a receptacle housing molded as a unitary plastic article, at least one latching channel formed on a side of the receptacle housing, each of the latching channels including a receptacle latching feature, a plug housing molded as a unitary plastic article, the plug housing being configured for mating with the receptacle housing by inserting at least a portion of the plug housing into the receptacle housing, and at least one metal latching tab inserted into a retaining channel formed on a side of the plug housing, the latching tab extending beyond the retaining channel so that a distal end of the latching tab can flex inward when pressed upon, the latching tab including a plug latching feature proximal to the distal end of the latching tab. The latching tabs, the retaining channels, and the latching channels are configured to cause the latching tabs to enter the latching channels and the plug latching features to engage with the receptacle latching features when the plug housing is fully mated with the receptacle housing, the plug latching features being disengagable from the receptacle latching features by pressing the distal ends of the latching tabs inward.

In embodiments, a tool is required to disengage the plug latching features from the receptacle latching features. In some embodiments, a pair of latching tabs are inserted into a pair of retaining channels formed on opposing sides of the plug housing, and a pair latching channels are formed on opposing sides of the receptacle housing.

In some embodiments, the receptacle latching features are inwardly extending protrusions formed from plastic of the receptacle housing, and the plug latching features are openings proximal to the distal ends of the latching tabs into which the receptacle latching protrusions extend when the plug housing is fully mated with the receptacle housing.

In other embodiments the plug latching features are outwardly extending latching hooks proximal to the distal ends of the latching tabs, and the receptacle latching features are openings in the latching channels into which the latching hooks extend when the plug housing is fully mated with the receptacle housing.

In some embodiments the plug housing includes pressing tabs attached to the plug housing by living hinges and at least partly covering the latching tabs, the pressing tabs being configured to flex the distal ends of the latching tabs inward and to disengage the plug latching features from the receptacle latching features when the plug housing is fully mated with the receptacle housing and the pressing tabs are pressed inward by fingers of a user.

In other embodiments the receptacle housing includes pressing tabs attached to the receptacle housing by living hinges and at least partly covering the latching tabs, the pressing tabs being configured to flex the distal ends of the latching tabs inward and to disengage the plug latching features from the receptacle latching features when the plug housing is fully mated with the receptacle housing and the pressing tabs are pressed inward by fingers of a user.

In various embodiments the receptacle housing and/or the plug housing includes latching tab covers that partly cover the latching tabs and prevent disengagement by a user's fingers of the plug latching features from the receptacle latching features, and the receptacle housing and/or the plug housing includes release openings into which a tool can be inserted to press on the latching tabs and release the plug latching features from the receptacle latching features. Some of these embodiments further include a tool for releasing the plug latching features from the receptacle latching features.

In certain embodiments at least one of the plug housing and the receptacle housing is configured for direct attachment to an electrical cable. In various embodiments at least one of the plug housing and the receptacle housing is configured for mounting to a panel.

And in some embodiments at least one of the plug housing and the receptacle housing includes an O-ring seat configured to accept an O-ring that inhibits entry of water into an interior of the system when the plug housing is fully mated with the receptacle housing.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1A:
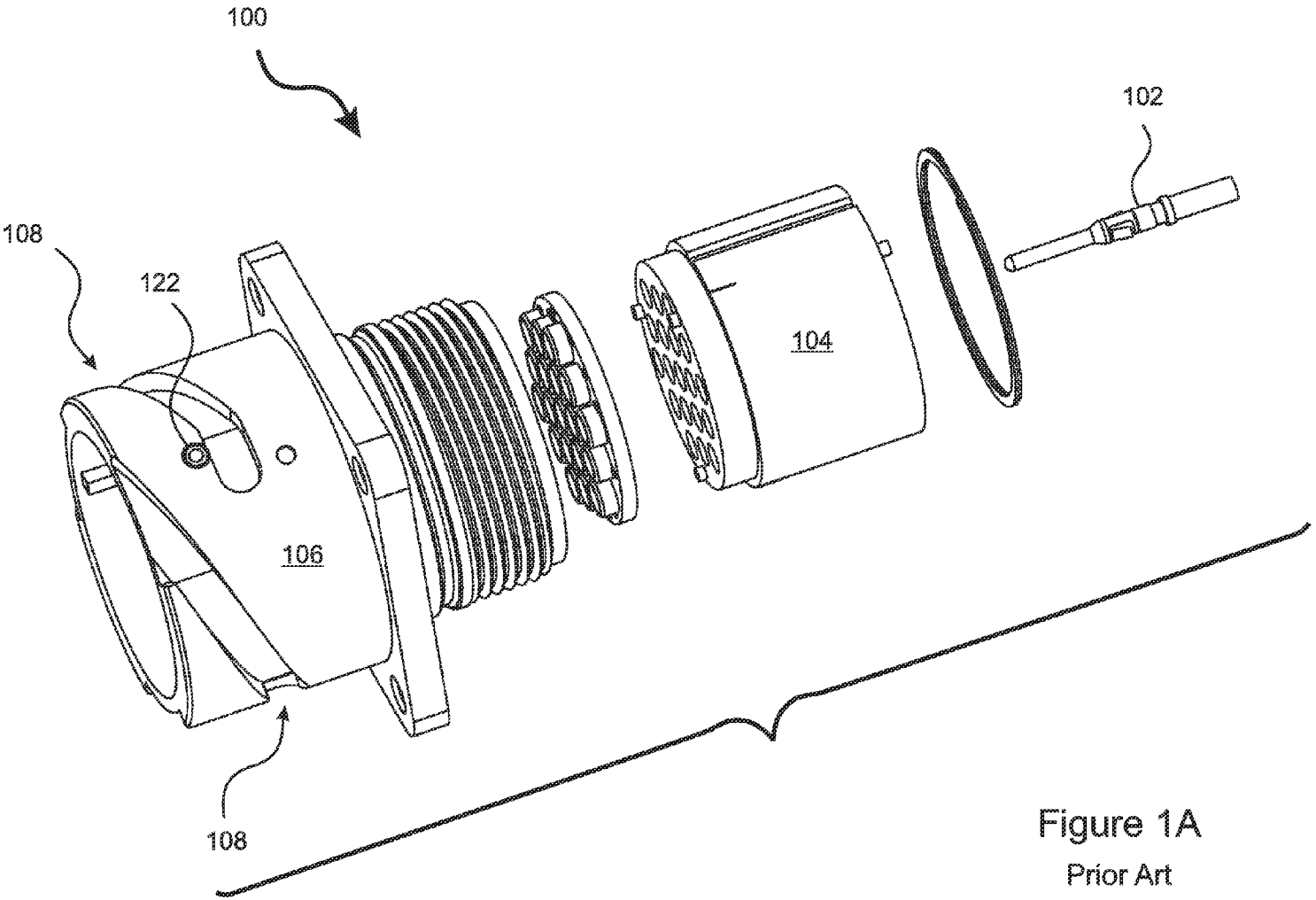
Figure 1A Prior Art
FIG. 1A is a perspective view of a mid-power plug housing of the prior art.
Figure 1B:
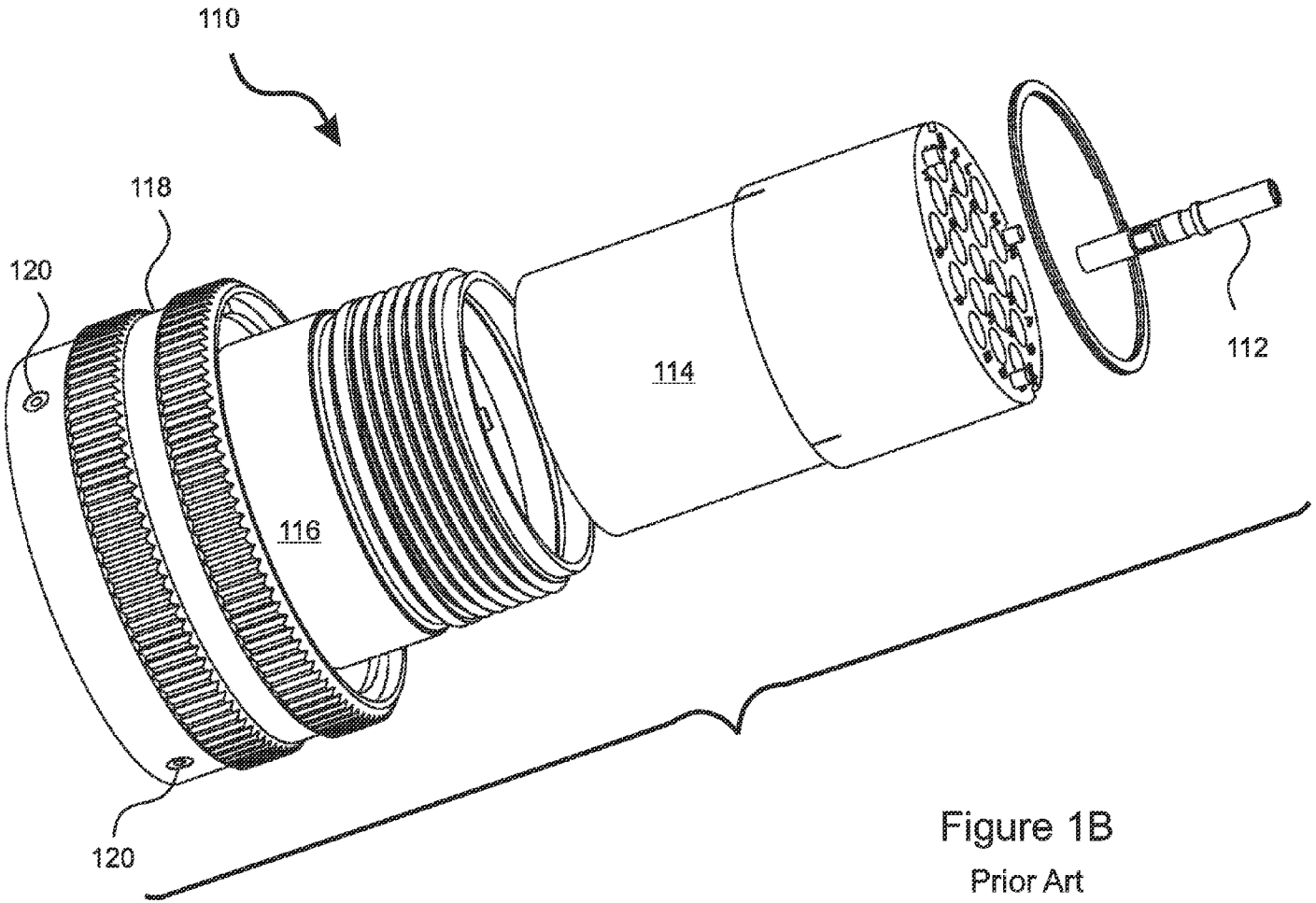
Figure 1B Prior Art
FIG. 1B is a perspective view of a mid-power receptacle housing of the prior art that is compatible with the plug housing of FIG. 1.
Figure 2A:
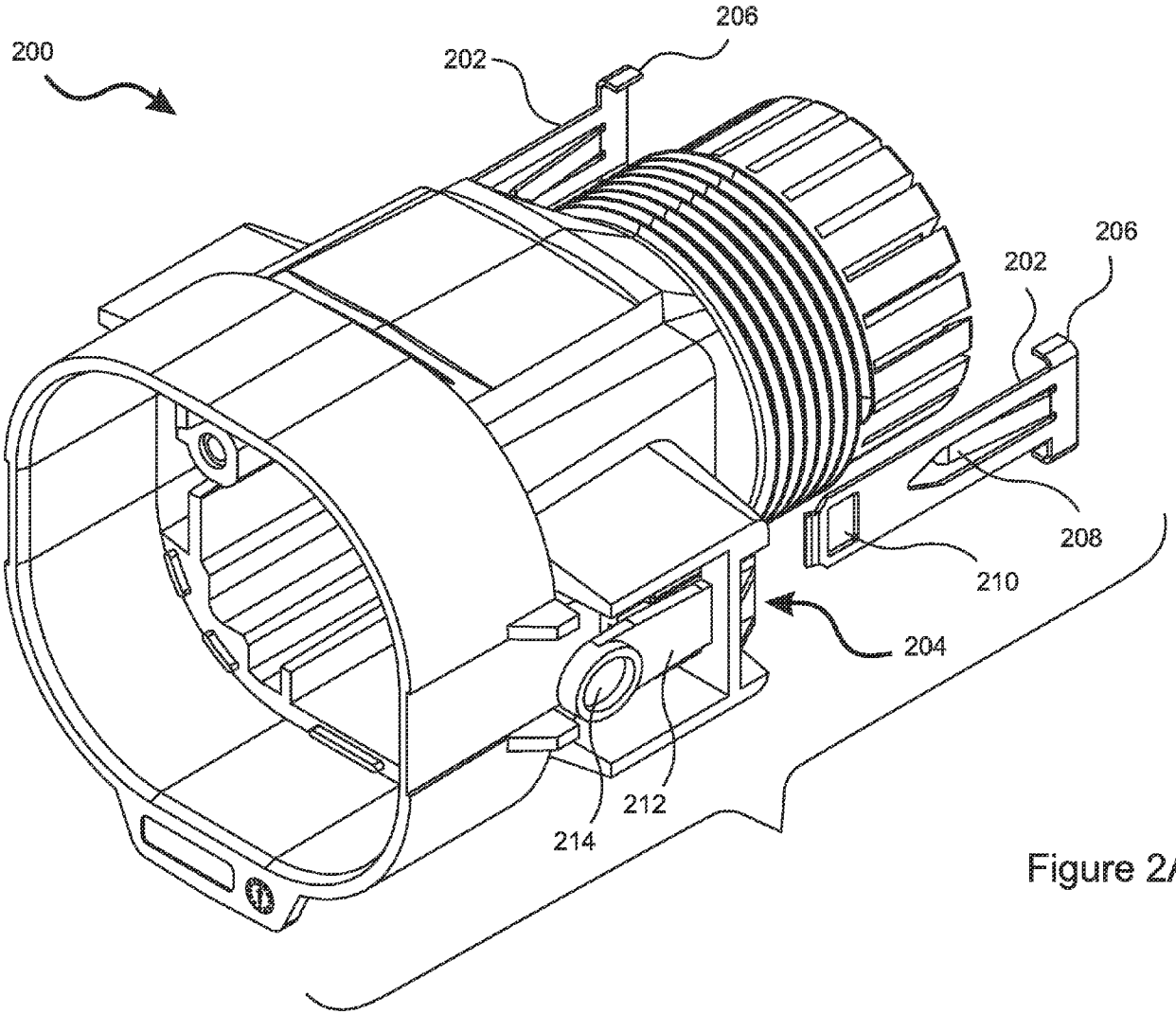
FIG. 2A is an exploded perspective view of a mid-power plug housing in an embodiment of the present invention.
Figure 2B:
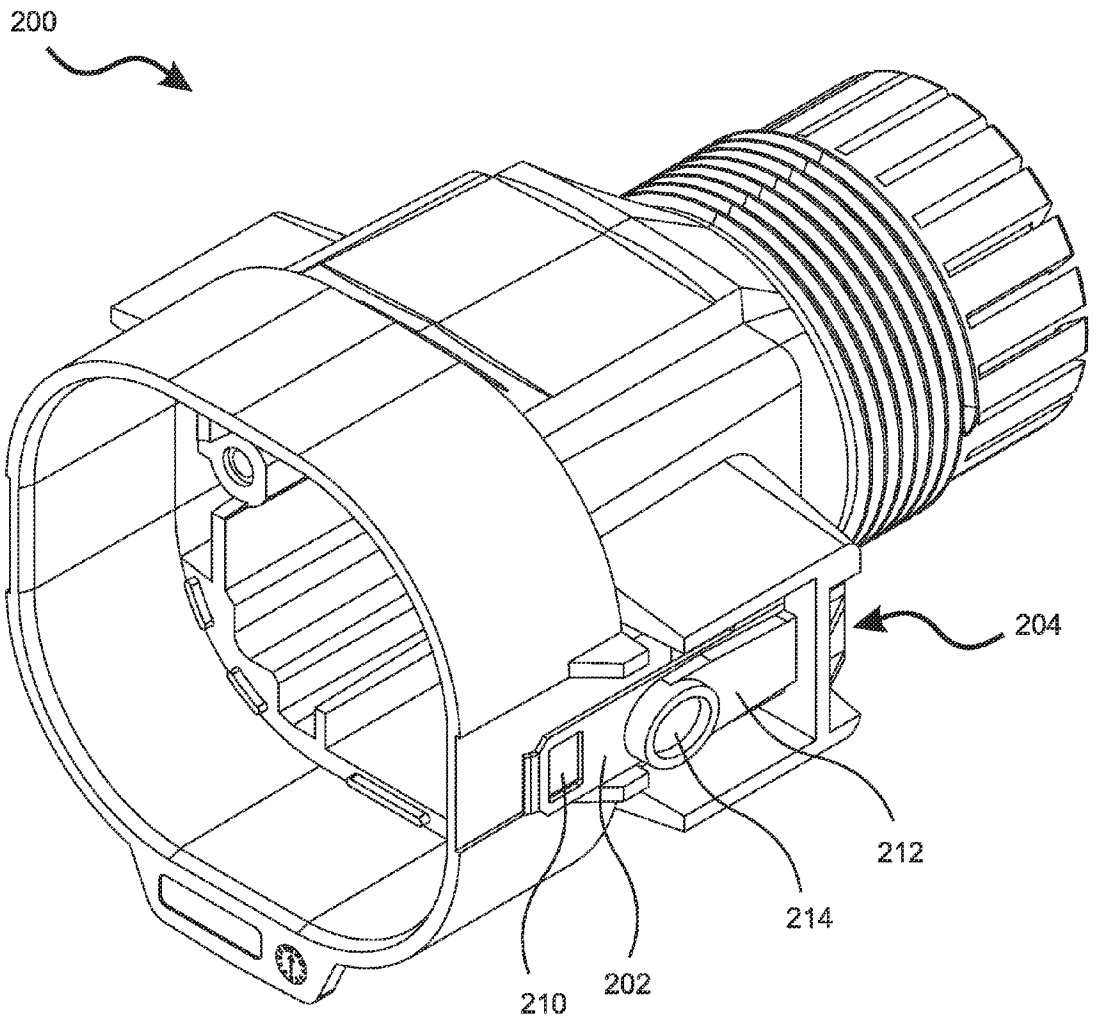
FIG. 2B is an assembled perspective view of the plug housing of FIG. 2A.

The present invention is a latching mechanism for a mid-power electrical connector system that is comfortable, easy, and safe to engage and release, even under cramped conditions, highly compact, durable, and inexpensive to manufacture. With reference to FIGS. 2A and 2B, the latching mechanism includes a plug housing 200 which is molded from plastic as a single piece, thereby minimizing its cost. One or more latching tabs 202 are inserted and retained in retaining channels 204 on one or more sides of the plug housing 200.

In the embodiment of FIGS. 2A and 2B, the latching tabs 202 include tails 206 that prevent them from being inserted too far into the retaining channels 204, and retaining hooks 208 that prevent them from being removed once they are inserted in the retaining channels 204. In the embodiment of FIGS. 2A and 2B the latching tabs 202 include openings 210 that engage with engagement features of the receptacle 300 when the connectors are mated. The embodiment of FIGS. 2A and 2B also includes plastic pressing tabs 212 that are formed in the illustrated embodiment as part of the plug housing 200 and can be pressed inward on living hinges so as to press upon and release the latching tabs 202. The pressing tabs 212 include pressing targets 214 that can be easily located by touch even if they are not directly visible, and which are comfortable to press on with fingers, since they are molded from plastic and lack any sharp edges that might be associated with the metal latching tabs 202.

FIG. 2A is an exploded perspective view of the plug assembly 200 of the illustrated embodiment, and FIG. 2B is an assembled perspective view of the embodiment of FIG. 2A.

Figure 3:
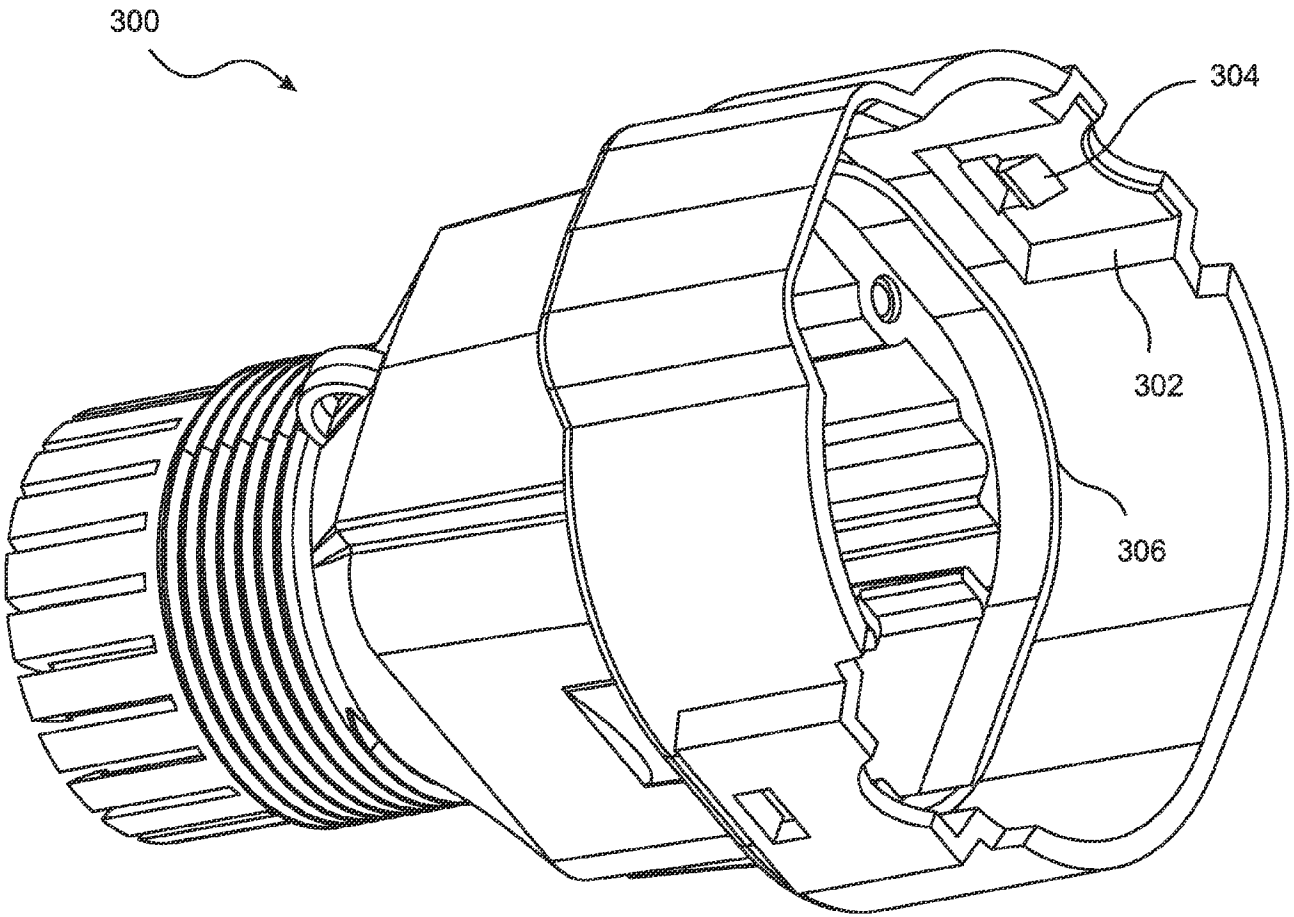
FIG. 3 is a perspective view of a mid-power receptacle housing in an embodiment of the present invention.

With reference to FIG. 3, the receptacle housing 300 is also molded from plastic as a single piece. The receptacle housing 300 includes latching channels 302 into which the latching tabs 202 are inserted when the housings are mated, and latching features 304 that engage the latching tabs 202. In the embodiment of FIG. 3, the latching features 304 are protrusions formed from the plastic of the latching channels that extend inwardly and are inserted into the openings 210 in the latching tabs 202 when the housings are mated. The latching features 304 in the illustrated embodiment are wedge shaped so as to automatically press the latching tabs 202 inward as the housings are mated, while resisting separation after mating until the pressing tabs 212 are pressed and the latching tabs 202 are thereby deflected inward until they are clear of the latching features 304. In the embodiment of FIG. 3, the receptacle housing also includes an O-ring seat 306 in which an O-ring can be installed so as to provide a water-resistant seal when the housings are mated.

Figure 4:
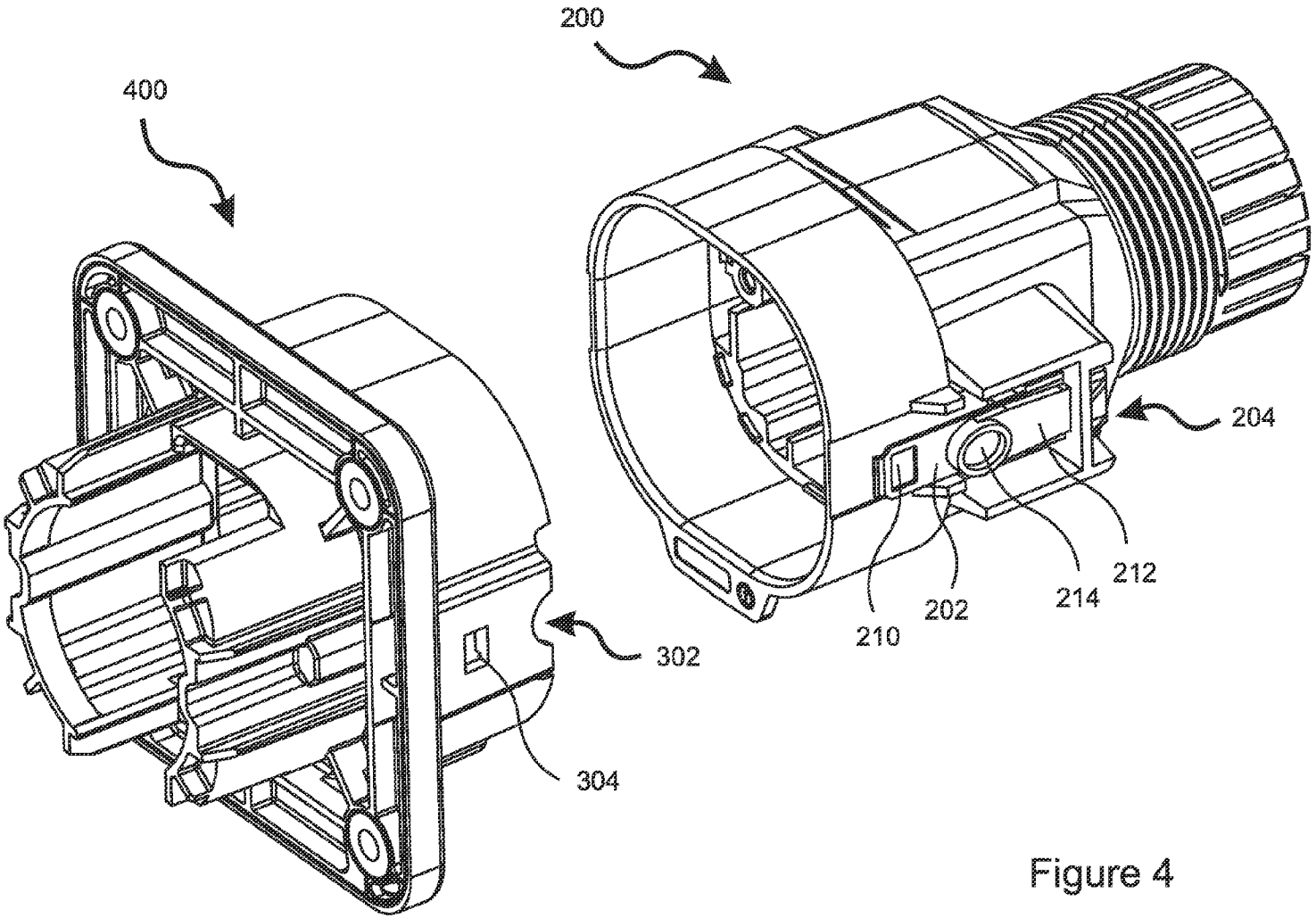
FIG. 4 is a perspective view of a receptacle housing and a plug housing aligned in preparation for connection in an embodiment of the present invention.
Figure 5:
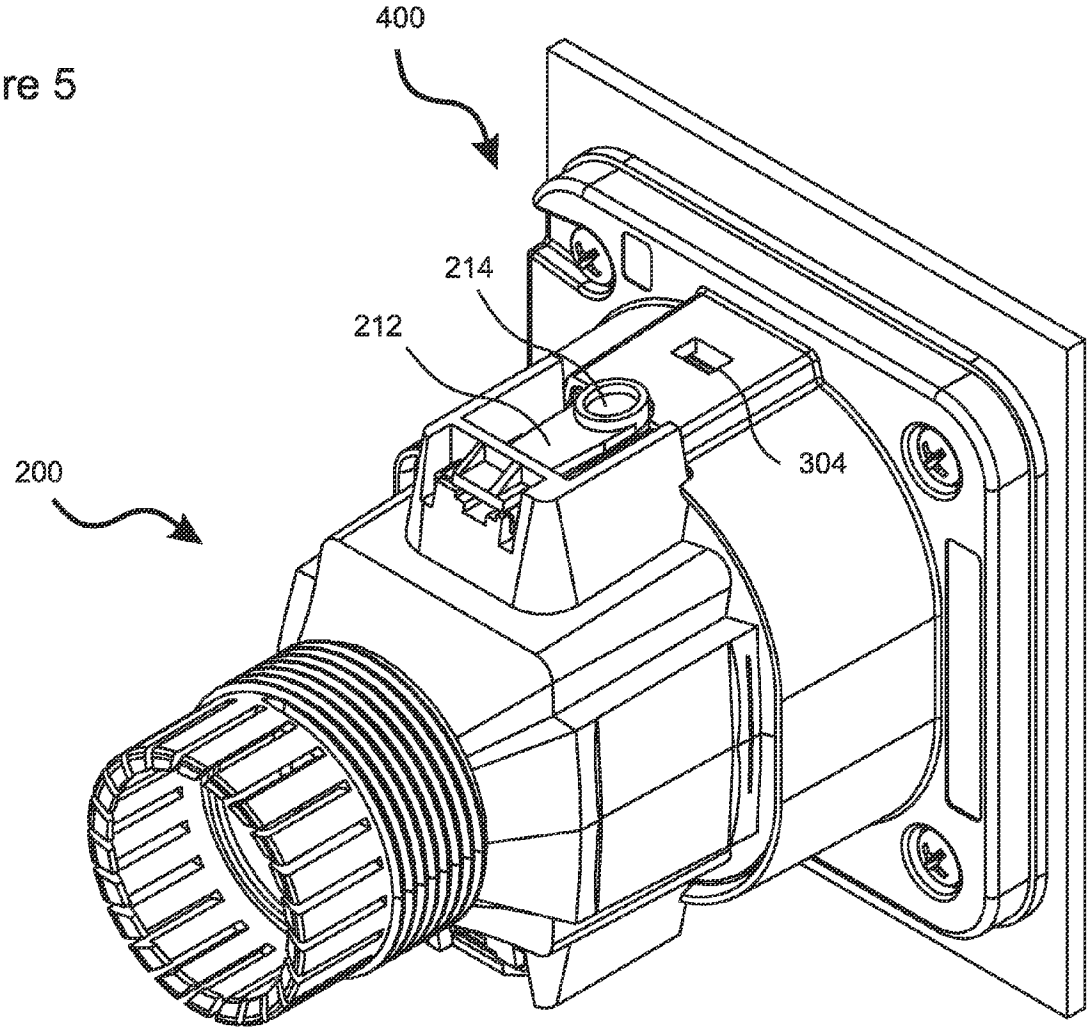
FIG. 5 is a perspective view of the receptacle and plug housings of FIG. 4 after connection.

FIG. 4 is a perspective illustration that shows the plug of FIG. 2B aligned with a panel-mountable receptacle 400 that includes latching features identical with the cable-mountable receptacle of FIG. 3. Mating of the two housings requires only that the two housings 200, 300 be aligned as shown, and then pushed together until the latching tabs 200 snap outward so that the holes 212 in the latching tabs 202 surround the latching features 304 of the receptacle 400. FIG. 5 is a perspective view of the two housings 200, 400 mated to each other, as seen from a different angle.

Figure 6A:
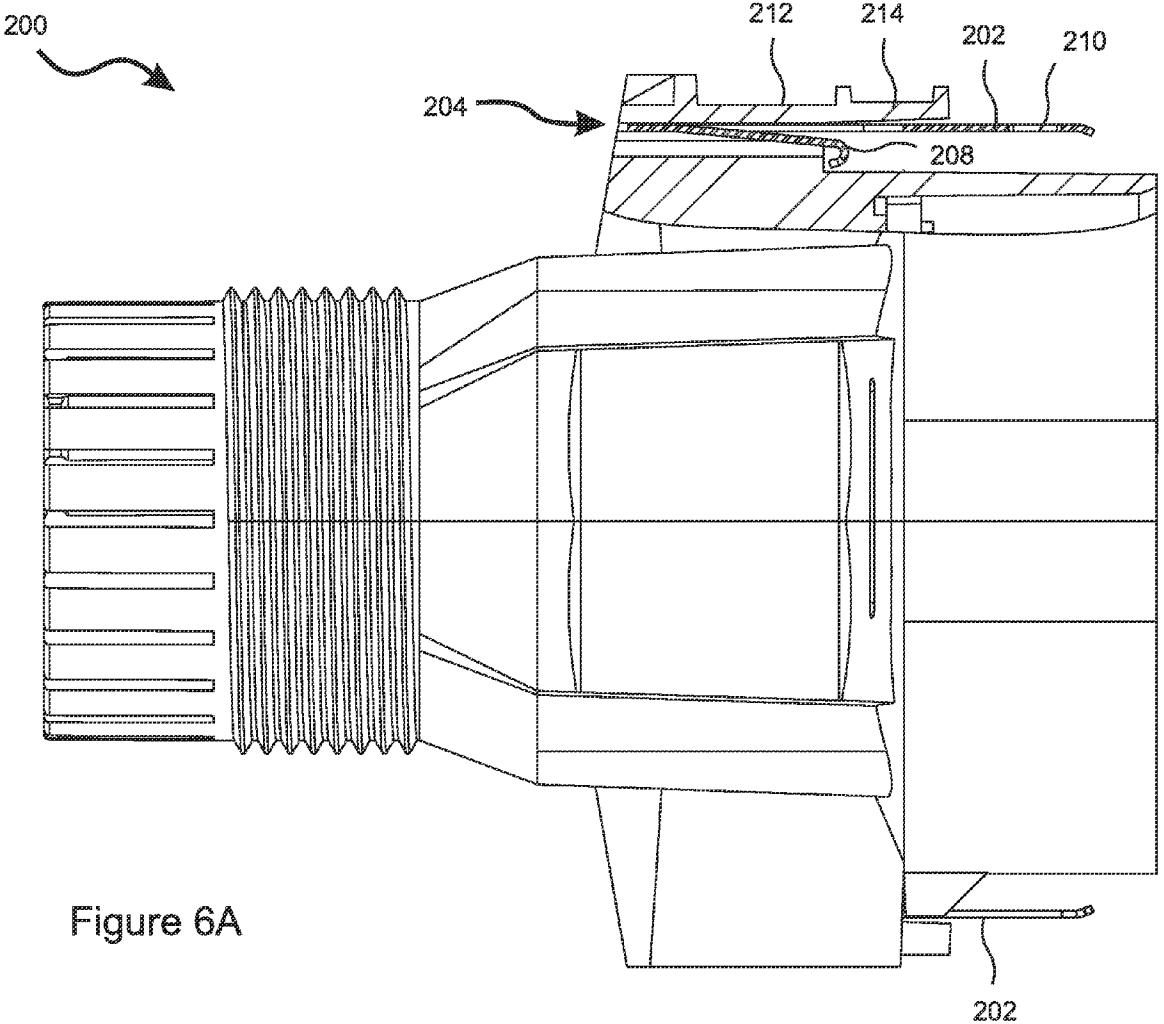
FIG. 6A is a partially sectional top view of the plug housing of FIG. 2B.
Figure 6B:
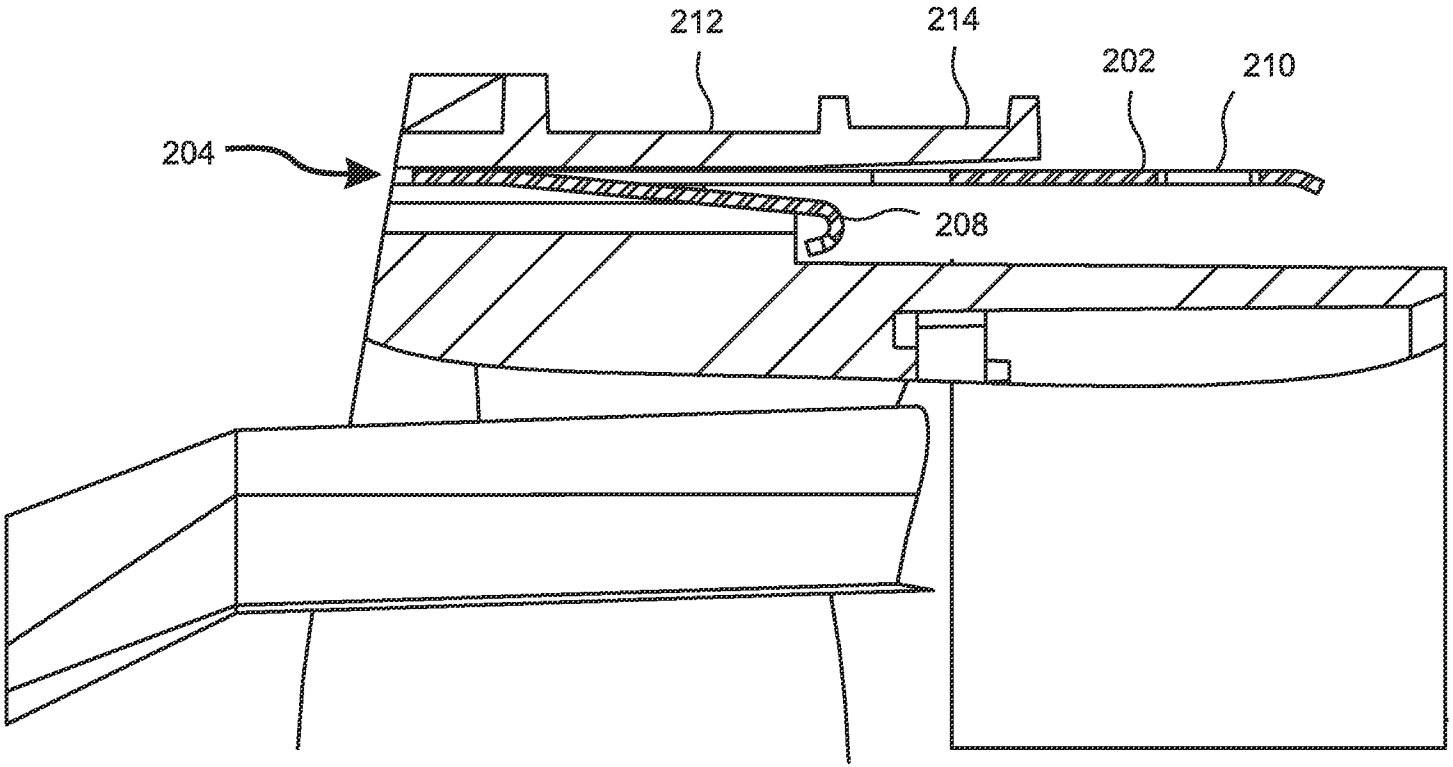
FIG. 6B is a close-up view of the sectional portion of FIG. 6A.

FIG. 6A is a top view of the plug housing of FIGS. 2A and 2B shown in a partial sectional view so that the placement of a latching tab 202 in a retaining channel 204 can be seen. The action of the retaining hook 208 in preventing removal of the latching tab 202 after it has been inserted in the retaining channel 204 can clearly be seen in the figure. FIG. 6B is an enlarged view of the sectional region of FIG. 6A.

Figure 7C:
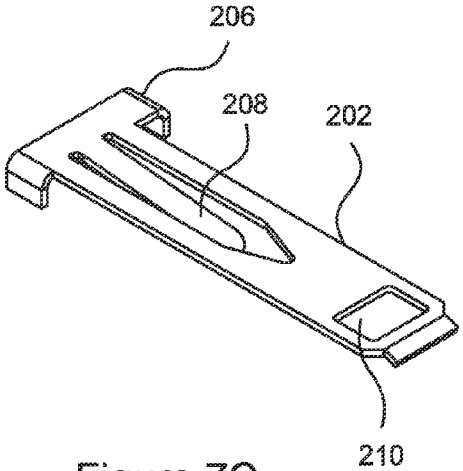
FIG. 7C is a perspective view of the latching tab of FIG. 7A.
Figure 7A:
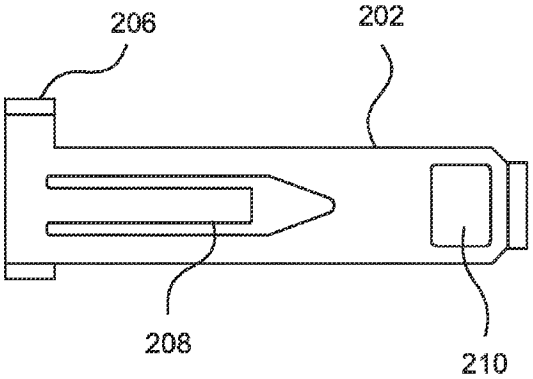
FIG. 7A is a top view of a latching tab in an embodiment of the present invention in which the latching tab includes an opening that engages with the latching feature of the receptacle housing.
Figure 7B:
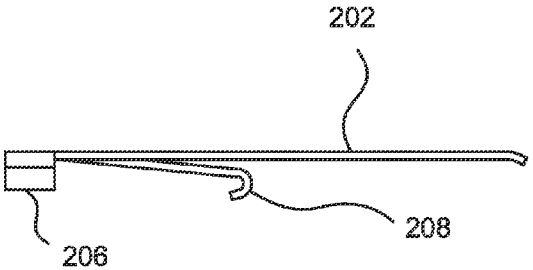
FIG. 7B is a side view of the latching tab of FIG. 7A.
Figure 8C:
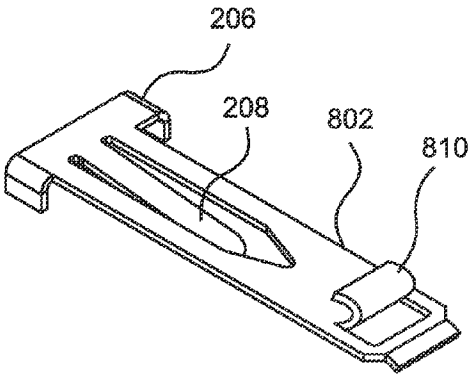
FIG. 8C is a perspective view of the latching tab of FIG. 8A.
Figure 8A:
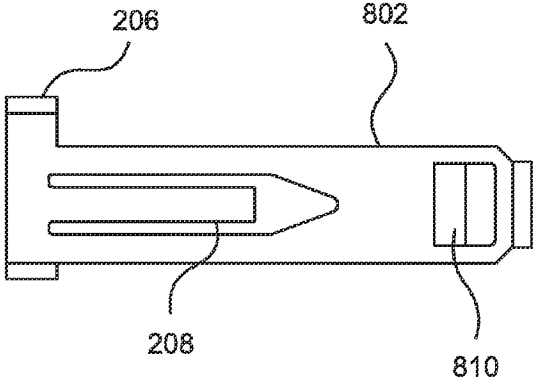
FIG. 8A is a top view of a latching tab in an embodiment of the present invention in which the latching tab includes a latching hook that engages with the latching feature of the receptacle housing.
Figure 8B:
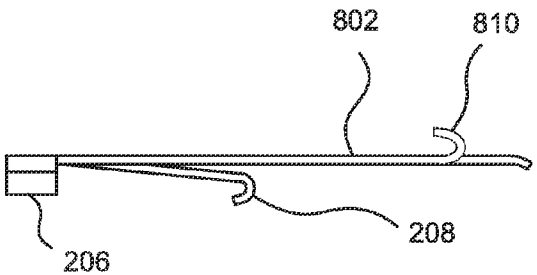
FIG. 8B is a side view of the latching tab of FIG. 8A.

FIGS. 7A through 7C are top, side, and perspective views respectively of the latching tab 202 of the embodiment of FIGS. 2A and 2B. FIGS. 8A, 8B, and 8C are similar views of a latching tab 802 that includes a latching hook 810 instead of a hole 210.

Figure 9:
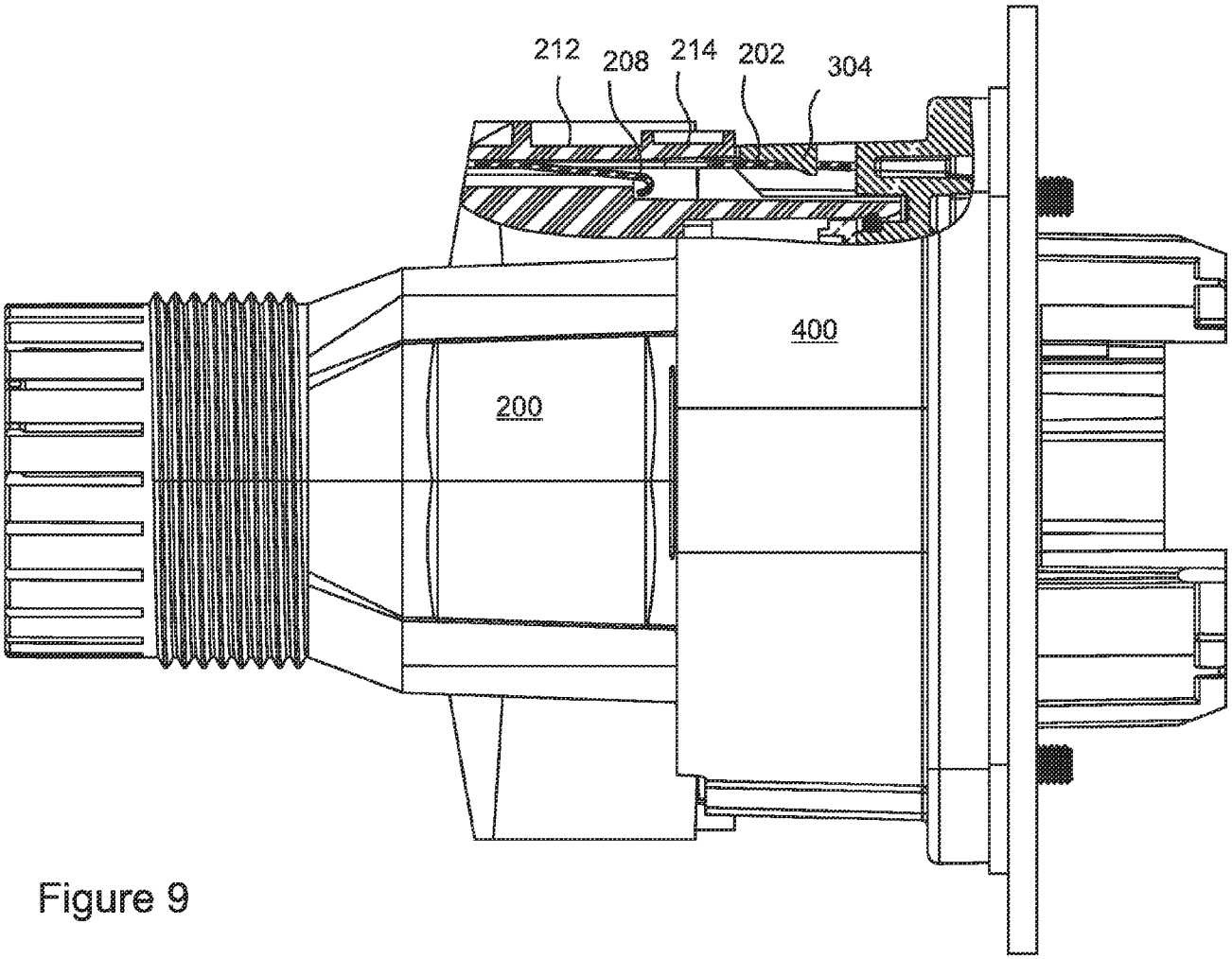
FIG. 9 is a partially sectional top view of the mated plug and receptacle housings of FIG. 5.
Figure 10:
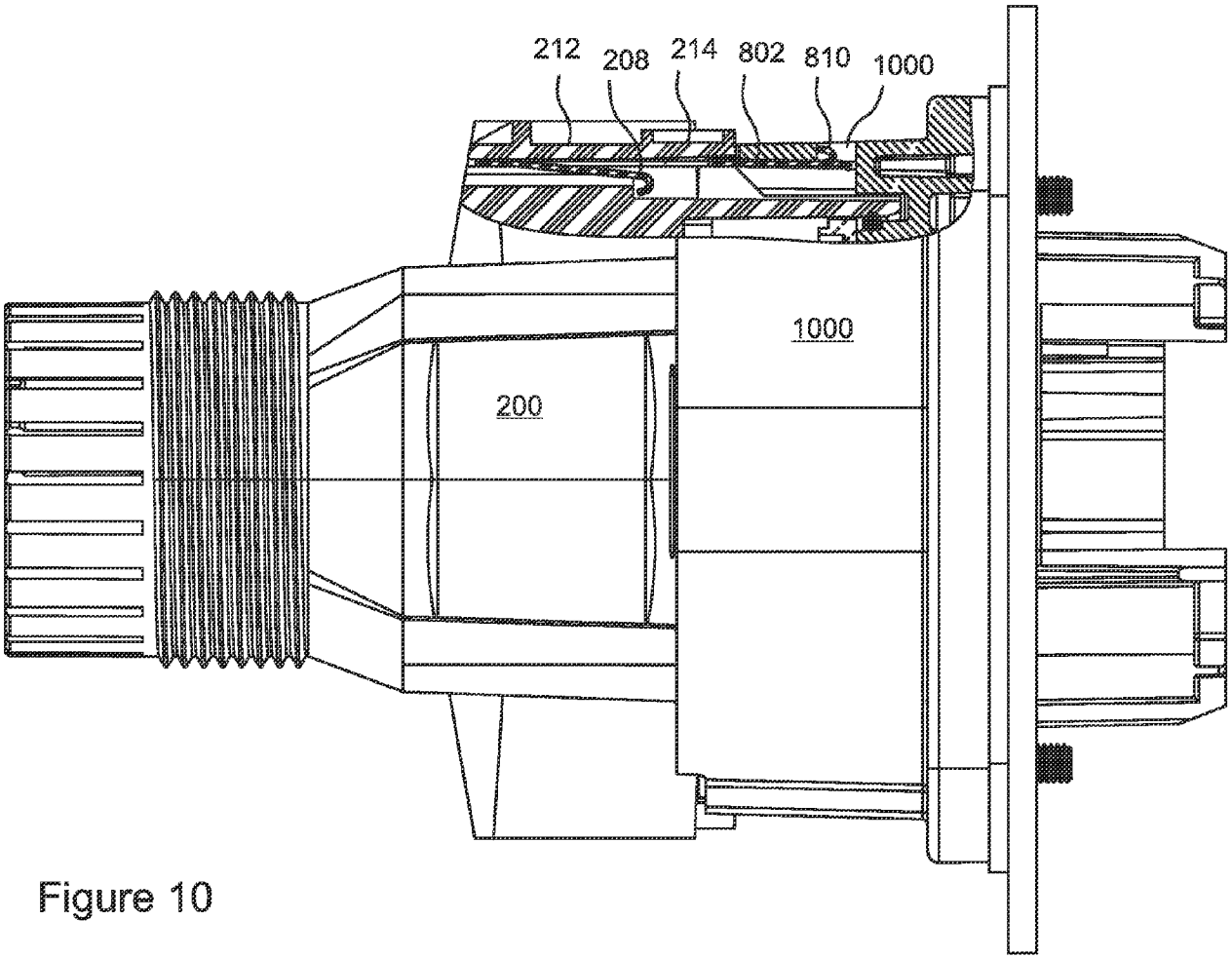
FIG. 10 is a partially sectional top view of mated plug and receptacle housing of an embodiment in which the latching tabs include latching hooks and the latching features are openings in the latching channels of the receptacle housing.

FIG. 9 is a partial sectional top view of the mated housings 200, 400 of FIG. 5. The penetration of the latching feature 304 of the receptacle housing 400 through the hole 210 in the latching tab 202 can be clearly seen in the sectional section. FIG. 10 is a similar illustration of an embodiment in which the latching tabs 802 of FIG. 8 having latching hooks 802 instead of holes 202 have been installed. It can be seen in the sectional region that when the connectors are mated, the latching hooks 810 snap outward into latching holes 1002 provided in the receptacle housing 1000.

Figure 11:
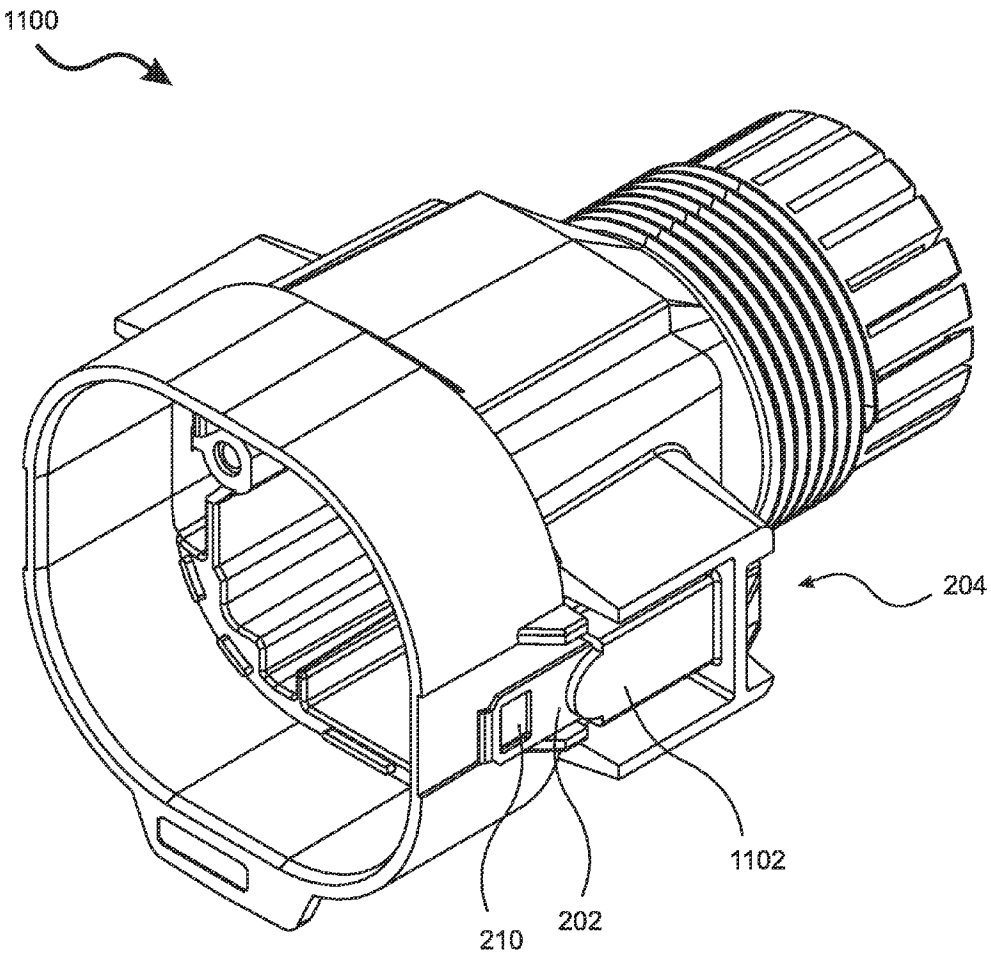
FIG. 11 is a perspective view of a plug housing of an embodiment in which the latching tabs are covered and cannot be accessed by fingers, thereby requiring a tool for disengagement.
Figure 12:
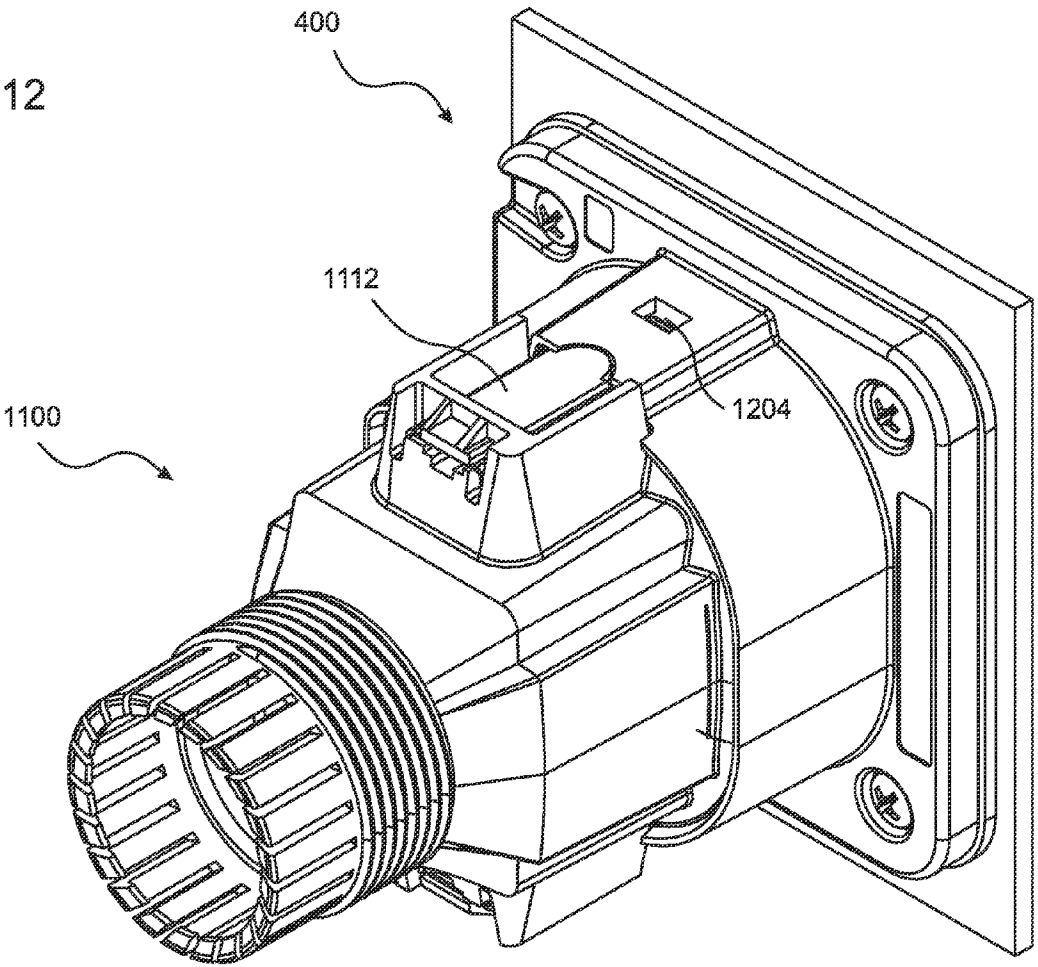
FIG. 12 is a perspective view of the plug housing of FIG. 11 mated with a compatible receptacle housing.

For some applications, applicable codes require that a tool must be necessary for releasing the latching mechanisms and separate the housings. FIG. 11 is a perspective view of a plug housing 1100 in an embodiment where the pressing tab 212 is replaced by a rigid cover 1112 that prevents a user from pressing on the latch tabs 202 without use of a tool. FIG. 12 is a perspective view showing the plug housing of FIG. 11 mated with the panel-mountable receptacle housing of FIG. 4. The rigid covers 1112 prevent release of the housings using fingers only. Instead, it is necessary to insert a small screwdriver or similar tool into the release openings 1204 provided as part of the latching features 304 of the receptacle 400. In some embodiments, there is enough play in the connectors to release the latching tabs 202 one at a time, while in other embodiments a special tool is provided which can press simultaneously on both latching tabs 202.

Figure 13:
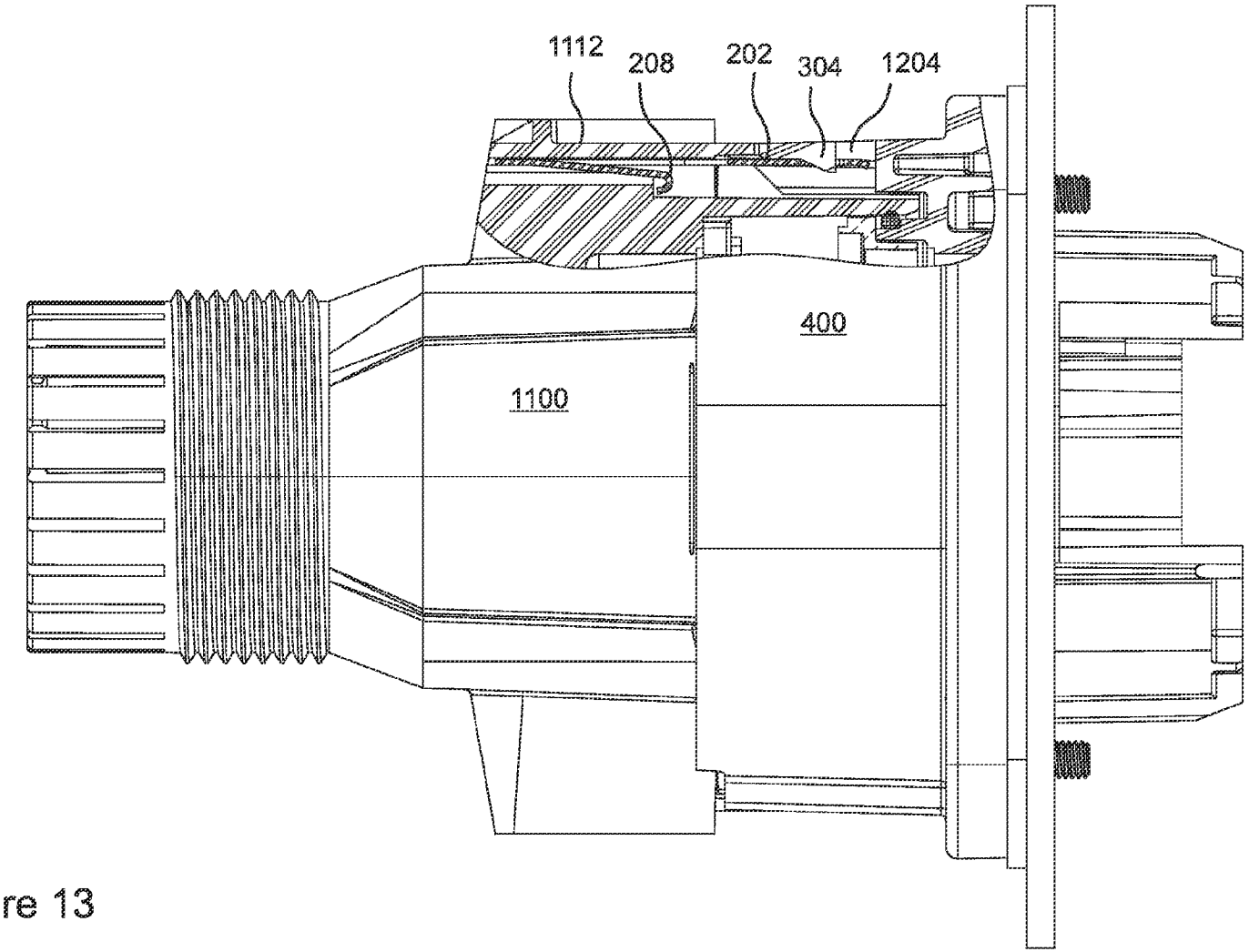
FIG. 13 is a partially sectional top view of the mated housings of FIG. 12.

FIG. 13 is a perspective sectional view similar to FIG. 9, but including the plug housing 1100 of FIG. 11.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. An electrical connector housing and latching system, comprising:

a receptacle housing molded as a unitary plastic article;

at least one latching channel formed on a side of the receptacle housing, the latching channel having a proximal end terminating within the receptacle housing and a distal end extending to a distal end of the receptacle housing, each of the latching channels including a receptacle latching feature;

a plug housing molded as a unitary plastic article, the plug housing being configured for mating with the receptacle housing by inserting at least a portion of the plug housing into the receptacle housing;

at least one metal latching tab inserted after molding and cooling of the plug housing into a retaining channel formed on a side of the plug housing, the latching tab extending beyond the retaining channel so that a distal end of the latching tab can flex inward when pressed upon, the latching tab including a plug latching feature proximal to the distal end of the latching tab, the latching tabs, the retaining channels, and the latching channels being configured to cause the latching tabs to enter the distal ends of the latching channels and the plug latching features to engage with the receptacle latching features when the plug housing is fully mated with the receptacle housing, the plug latching features being disengagable from the receptacle latching features by accessing the latching tabs from a lateral direction that is substantially perpendicular to the latching tabs, and pressing the distal ends of the latching tabs inward; and at least one pressing tab attached either to the plug housing or to the receptacle housing by a living hinge, and at least partly covering a corresponding latching tab, the pressing tab being configured to flex the distal end of the corresponding latching tab inward and to disengage the plug latching feature from the receptacle latching feature when the plug housing is fully mated with the receptacle housing and the pressing tab is pressed inward by a finger of a user.

2. The system of claim 1, wherein a tool is required to disengage the plug latching features from the receptacle latching features.

3. The system of claim 1, wherein:

a pair of latching tabs are inserted into a pair of retaining channels formed on opposing sides of the plug housing; and a pair latching channels are formed on opposing sides of the receptacle housing.

4. The system of claim 1, wherein the receptacle latching features are inwardly extending protrusions formed from plastic of the receptacle housing, and the plug latching features are openings proximal to the distal ends of the latching tabs into which the receptacle latching protrusions extend when the plug housing is fully mated with the receptacle housing.

5. The system of claim 1, wherein the plug latching features are outwardly extending latching hooks proximal to the distal ends of the latching tabs, and the receptacle latching features are externally accessible openings in the latching channels into which the latching hooks extend when the plug housing is fully mated with the receptacle housing.

6. The system of claim 1, wherein:

at least one of the receptacle housing and the plug housing includes latching tab covers that partly cover the latching tabs and prevent disengagement by a user's fingers of the plug latching features from the receptacle latching features; and at least one of the receptacle housing and the plug housing includes release openings into which a tool can be inserted to press on the latching tabs and release the plug latching features from the receptacle latching features.

7. The system of claim 6, further comprising a tool for releasing the plug latching features from the receptacle latching features.

8. The system of claim 1, wherein at least one of the plug housing and the receptacle housing is configured for direct attachment to an electrical cable.

9. The system of claim 1, wherein at least one of the plug housing and the receptacle housing is configured for mounting to a panel.

10. The system of claim 1, wherein at least one of the plug housing and the receptacle housing includes an O-ring seat configured to accept an O-ring that inhibits entry of water into an interior of the system when the plug housing is fully mated with the receptacle housing.

* * * * *